US006027080A

United States Patent [19]

Sziraki

[11] Patent Number: 6,027,080

[45] Date of Patent: Feb. 22, 2000

[54] FOREARM AND WRIST SUPPORT

[75] Inventor: Michelle Ann Sziraki, Southgate, Mich.

[73] Assignee: Mastech Enterprises, Inc., Willis, Mich.

[21] Appl. No.: 08/249,611

[22] Filed: May 26, 1994

[51] Int. Cl.[7] ..... B43L 15/00

[52] U.S. Cl. ..... 248/18.5; 248/118.1

[58] Field of Search ..... 248/118, 118.1, 248/118.3, 118.5, 205.2, 918; 400/715, 718

[56] References Cited

U.S. PATENT DOCUMENTS

| | | | |
|---|---|---|---|
| 226,411 | 4/1880 | McElroy . | |
| 986,620 | 3/1911 | Ballon . | |
| 5,125,606 | 6/1992 | Cassano | 248/118 |
| 5,165,630 | 11/1992 | Connor | 248/118.1 |
| 5,193,771 | 3/1993 | Hassel | 248/118 |
| 5,203,527 | 4/1993 | Rubey | 248/118 |
| 5,203,845 | 4/1993 | Moore | 248/118 |
| 5,265,835 | 11/1993 | Nash | 248/118 |
| 5,335,888 | 8/1994 | Thomsen | 248/118.5 |
| 5,340,067 | 8/1994 | Martin | 248/118.5 |
| 5,370,346 | 12/1994 | Long | 248/118.5 |
| 5,388,271 | 2/1995 | Sessoms | 2/115 |

*Primary Examiner*—Leslie A. Braun
*Assistant Examiner*—Gwendolyn Baxter
*Attorney, Agent, or Firm*—Daniel R. Edelbrock

[57] ABSTRACT

A forearm and wrist support for computer mouse users. The support is made of a foam inner cushion covered by an outer shell of soft, durable, breathable material. The foam has a density which resists bending. The outer shell may be, for example, POLARTEC fabric. The bottom surface of the support is comprised of nylon for smooth, easy, controllable sliding movement of the support over a table or desk top. The length of the support is sized to hold the elbow and wrist in a straight line, supporting the underside of the wrist and nearly the entire length of the forearm. A groove extends along the length of the support and is contoured to provide a comfortable, natural rest without gripping the forearm. The wrist end of the support inclines outward from the bottom surface of the support to the groove depth so the mouse may be snugly fit against the wrist end of the support. When the forearm and wrist support is used properly, the forearm and wrist are supported comfortably and the hand and fingers extend levelly and naturally over the mouse.

16 Claims, 2 Drawing Sheets

FOREARM AND WRIST SUPPORT

BACKGROUND OF THE INVENTION

1.) Field of the Invention

This invent ion relates to a forearm and wrist support for computer mouse users.

A mouse is a hand held pointer used to manipulate the cursor on the display screen of a personal computer (pc). When operating a computer mouse, the user will generally rest the forearm on the table or desk top and bend the wrist upward to position the hand around the mouse and the finger tips adjacent the button or buttons on the mouse. Sometimes the user does not use the table, desk top or anything else to support the forearm or wrist, moving the forearm and wrist into all sorts of different positions and angles.

Applicant has spoken with doctors regarding wrist pain caused by use of a computer mouse on a table or desk top over many hours. It was suggested that to alleviate or prevent such pain, the forearm and wrist should stay straight and be supported. The wrist should not be bent up or down in a continuous, repetitious movement because this puts stress on tendons and nerves. Tendinitis and arthritis may be caused or aggravated by such movement. Repetitive stress injury (RSI) is caused by this bend in the wrist as finger motion in this position makes the muscles of the wrist work harder and increases the friction on the tendons. The muscles can shorten and cramp, and the tendons swell, compressing the nerve that connects with the thumb and first two fingers of the hand. Carpal tunnel syndrome, a common form of RSI, is the resulting numbness and tingling in those fingers. These injuries make simple acts, such as turning a doorknob, painful or impossible.

Keeping the elbow and wrist in a straight line and supporting the forearm helps to prevent or relieve these injuries, according to applicant's research and experience. In the invention of this application, applicant has used this information to design a unique forearm and wrist support.

2.) Description of Related Art

U.S. Pat. No. 226,411 to McElroy discloses an arm-rest for writers which is wrapped around the forearm. This is cumbersome and, since the rest is filled mostly with air, these is no firm support for the forearm and wrist. From the description, it is clear the McElroy device is designed to change in form to allow the rest to adapt its shape as muscular action changes the shape of the forearm.

U.S. Pat. No. 561,562 to Brownson et al provides an arm-rest with a solid, heavy base meant to keep the rest stationary in front of a telegraph key. This gives no support to the elbow which remains on the desk top. In U.S. Pat. No. 986,620 to Ballou, a metal wrist pad uses ball bearings to allow ease of movement of the forearm across a desktop.

The devices set forth by Cassano et al in U.S. Pat. No. 5,125,606 and Rubey in U.S. Pat. No. 5,203,527 are meant only as wrist supports, as illustrated in their figures. The supports would not keep the elbow and wrist in a straight line, and the non-skid backings or attachments to the keyboard make the supports stationary or hard to move.

In his U.S. Pat. No. 5,165,630 Connor teaches the use of a small pad directly attached to a computer mouse. There is no forearm support and no way for a user to adjust the position of the pad relative to the mouse for better comfort. The Moore device disclosed in U.S. Pat. No. 5,203845 actually supports the mouse, and the shape of the wrist-support portion of the device appears to require the user to bend the wrist out of line with the forearm.

U.S. Pat. No. 5,193,771 to Hassel et al shows another wrap around wrist support. There is no support for the forearm and no way to keep the wrist and elbow in a straight line. If the wrist support was used with a mouse, the configuration of the support would make it awkward to move the forearm across the table or desk top. Since the support binds the wrist in the neutral position, it might have to be removed every time the user needs to perform some other work function.

The prior art also includes pillows which support only the wrist. One type of pillow available on the market comprises a POLARTEC fabric surrounding a buckwheat hull filling. These pillows are meant for comfort and do not provide firm support for even the wrist. Some interfere with ease of movement of the computer mouse. They are comparable to beanbags.

SUMMARY OF THE INVENTION

Accordingly, it is an object of this invention to provide a forearm and wrist support for computer mouse users which keeps the elbow and wrist in a straight line.

Another object of this invention is to provide a support which is comfortable and positions the hand and fingers naturally over the mouse, keeping the wrist in a neutral, unbent position.

A further object of this invention is to provide a forearm and wrist support which may be moved easily and smoothly in a controllable manner over a table or desk top.

A still further object of this invention is to provide a support which is stiff, durable and washable.

In carrying out this invention in the illustrative embodiment thereof, a forearm and wrist support has a length of approximately nine and one-half inches to cradle the underside of the wrist and nearly the entire length of the forearm. This keeps the elbow and wrist in a straight line. The support has a top surface which is curved across the width of the support, forming a groove extending along the whole length of the support. The groove is contoured to generally conform to the shape of the forearm without enfolding or gripping the forearm. The groove has a gradual upward incline to the wrist end of the support to hold the forearm and wrist with greater comfort and position the hand and fingers levelly over the mouse without need for bending the wrist. The wrist end of the support has an outward incline so the mouse may be snugly fit against the support and easily moved with the support.

The support has a foam inner cushion. The foam has a density which resists bending if, for example the support is used in a position where it overhangs the edge of a table or desk top. The foam inner cushion is covered by a soft, durable, washable, breathable material like POLARTEC fabric. The support is therefore an extremely comfortable and natural rest, and helps relieve aching wrists. The bottom surface of the support is comprised of nylon so the support slides easily and smoothly, but in a controllable manner, across a table or desk top as the user maneuvers the mouse.

BRIEF DESCRIPTION OF THE DRAWINGS

This invention, together with other objects, features, aspects, and advantages thereof, will be more clearly understood from the following description, considered in conjunction with the accompanying drawings.

COMPLETE DESCRIPTION OF THE PREFERRED EMBODIMENT

Figure 1:
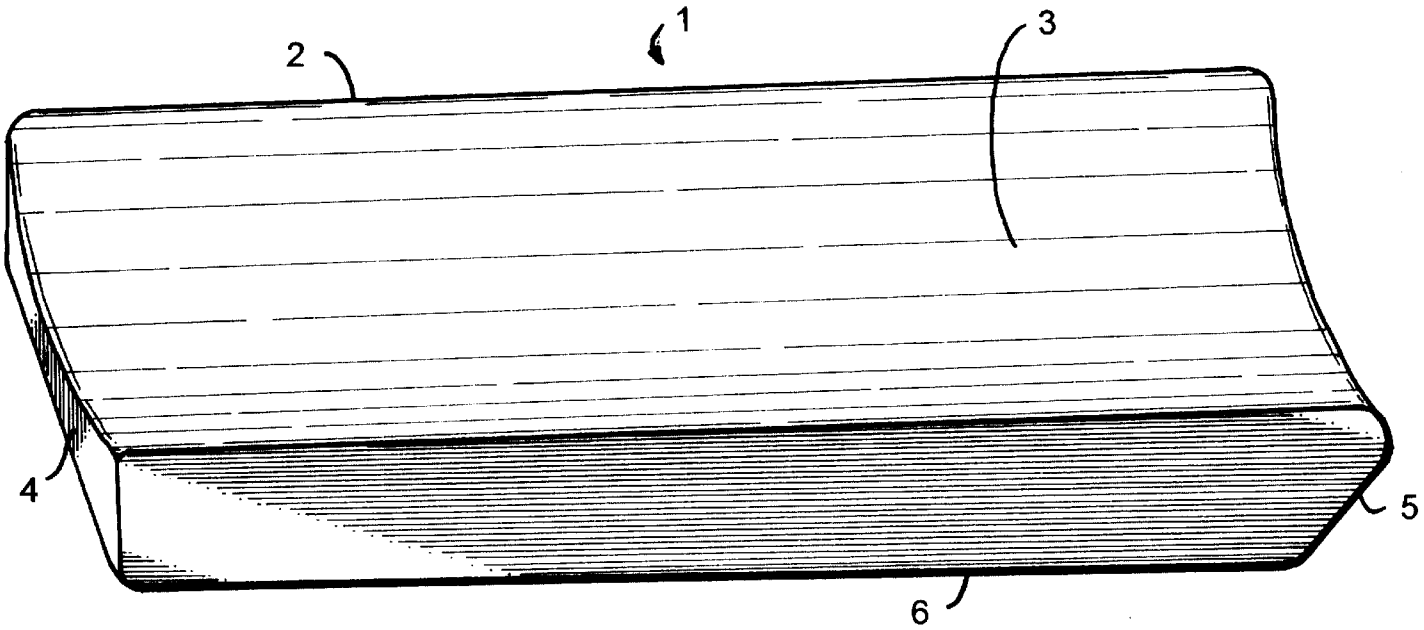
FIG. 1 is a perspective view of the forearm and wrist support of this invention.

Referring now to FIG. 1, the forearm and wrist support 1 of this invention is illustrated smaller than its actual size. The support 1 is about nine and one-half inches long. The length was chosen based on the notions that the distance between a person's elbow and wrist is equal to the length of the person's foot, and the average of male and female foot sizes is approximately nine and one-half inches. The forearm and wrist support 1 is therefore designed to adequately support the forearm and wrist of most men and women. The support 1 is approximately four inches in width, wide enough to support broad forearms and wrists.

The top surface 2 of the forearm and wrist support 1 is curved transversely (across the width) of the support 1 to form a channel, furrow or groove 3 extending along the entire length of the support 1. The groove 3 is contoured to conform generally to the roundness of the forearm, providing comfort and stability but not enfolding or gripping the forearm. As shown more clearly in the FIG. 2 side view, the end 4 of the support 1 is approximately vertical, but the other end 5 of the support 1 is inclined outwardly from the bottom surface 6 of the support 1 to the area adjacent the groove 3 depth.

Figure 2:
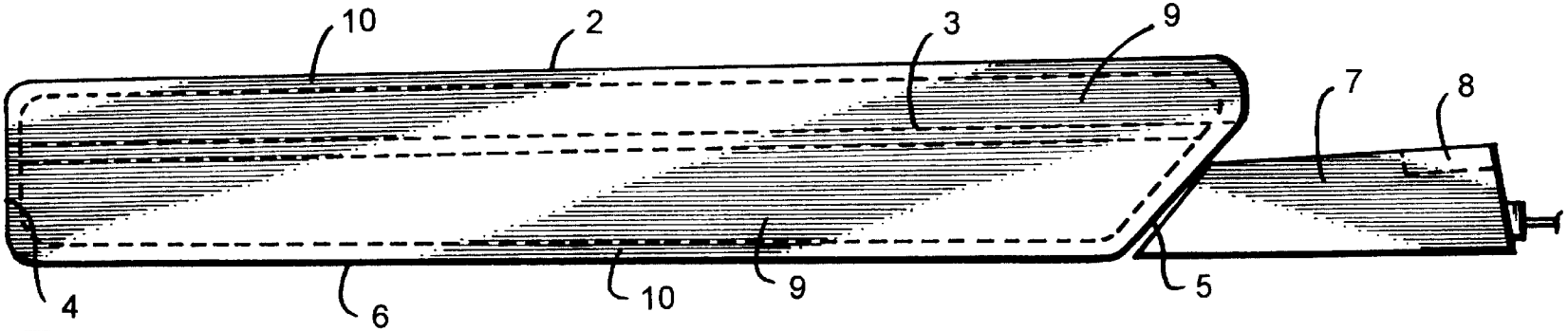
FIG. 2 is a side view of the forearm and wrist support shown with a computer mouse.

As illustrated in FIG. 2, the reason for the inclined end 5 of the support 1 is to allow a user to fit the computer mouse 7 snugly against the support 1. In this way the user may easily reach the mouse 7 and mouse button or buttons 8 with the hand and fingertips while the wrist is supported in the neutral, unbent position in a straight line with the elbow by the forearm and wrist support 1. By snugly fitting the mouse 7 against the inclined end 5 of the support 1, it is also easier to move the support 1 and mouse 7 together smoothly and dexterously across the table or desk top.

The height of the forearm and wrist support 1 at the inclined end 5 from the bottom surface 6 to the groove 3 depth is approximately one inch. This height was chosen so the wrist does not need to bend for the hand to reach the mouse 7. The angle of the inclined end 5 is approximately forty-five degrees. The complete height of the support 1 varies slightly from about one and three-eights inches at the vertical end 4 to about one and one-half inches total at the inclined end 5. The groove 3 has a slight upward angle from the vertical end 4 of the support 1 to the inclined end 5 of about two or three degrees. This provides more comfortable and natural positioning of the forearm and wrist. The depth of the groove 3 is about one-half inch at both ends 4 and 5 of the support 1.

The forearm and wrist support 1 comprises an inner cushion 9 covered with an outer shell 10. It has been found that foam works superbly as the inner cushion 9. To make the inner cushion 9, foam ingredients are poured into a mold and allowed to solidify. The foam ingredients should be of the type which provide a soft cushion 9 with a stiffness that resists bending of the support 1 when, for example, the support 1 is positioned such that it overhangs the edge of a table or desk top. In other words, the density of the foam is chosen so the foam inner cushion 9, and therefore the support 1, will not give or bend too much when the support 1 hangs over the edge of a work station, so the forearm and wrist continue to be supported. The foam inner cushion 9 has a quite noticeable comfort and durability.

The outer shell 10 should be made of a soft, breathable material. POLARTEC fabric works well. The fabric is comfortable, breathable, nonstaining and absorbs perspiration. POLARTEC is also washable, durable and non-piling. POLARTEC is described by its manufacturers as a knitted polyester with other material such as cotton, wool, nylon or rayon included to perform a specific function. The fabric is hard to sew and otherwise work with because it stretches, so a pattern of the outer shell 10 is cut out, then folded and cut again to fit around and cover the inner cushion 9. Contact cement, glue or other adhesive is used to secure the outer shell 10 to the inner cushion 9.

Figure 3:
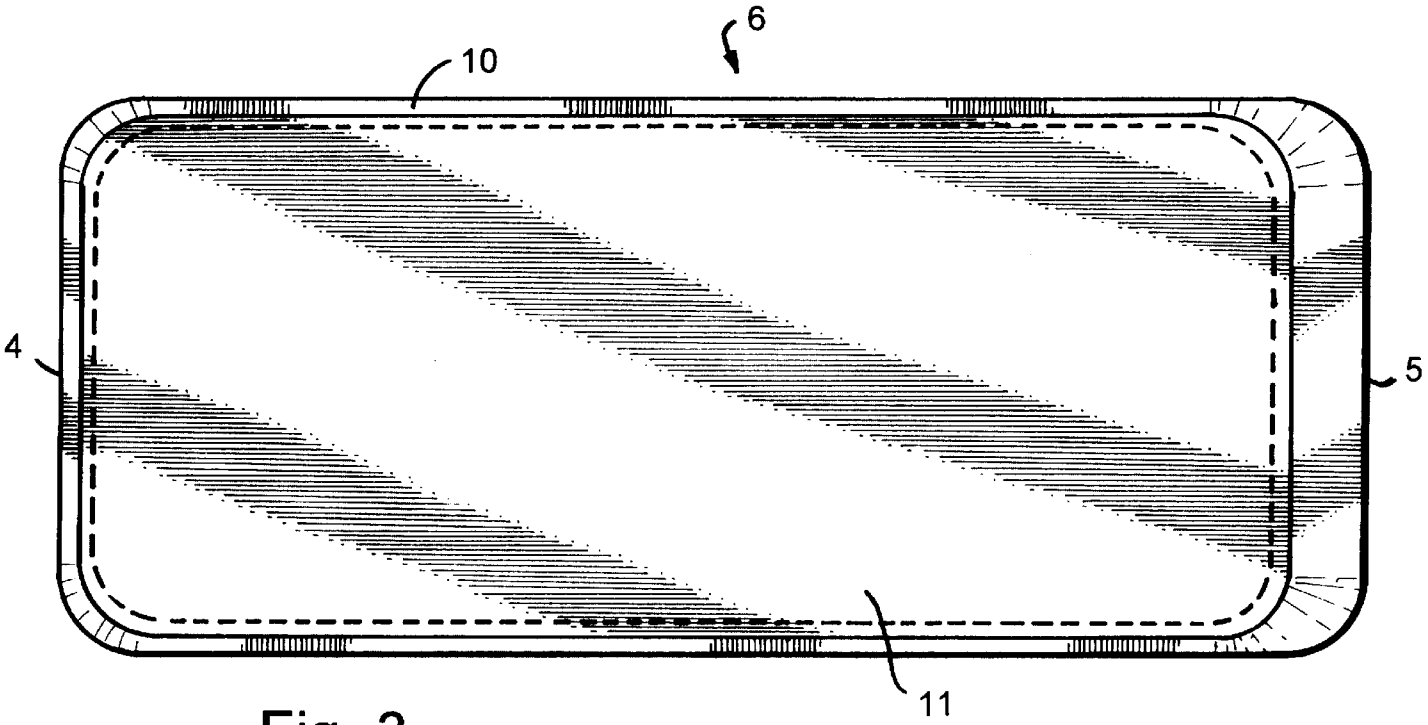
FIG. 3 is a bottom view of the forearm and wrist support.

The outer shell 10 does not cover the bottom surface 6 of the support 1. FIG. 3 illustrates the bottom surface 6 of the forearm and wrist support 1. The POLARTEC fabric or other suitable material forming the outer shell 10 is folded and secured around the bottom edges of the inner cushion 9. A rectangular piece of material 11 is secured by contact cement, glue or other adhesive to the bottom of the inner cushion 9 and, ideally, to the outer shell 10 folded around the bottom edges of the inner cushion 9. Nylon works effectively as the material 11 because a nylon bottom surface 6 allows the forearm and wrist support 1 to move and turn smoothly and easily on a table or desk top, but the nylon is not so slick that the support 1 is unsteady or slides without control.

Figure 4:
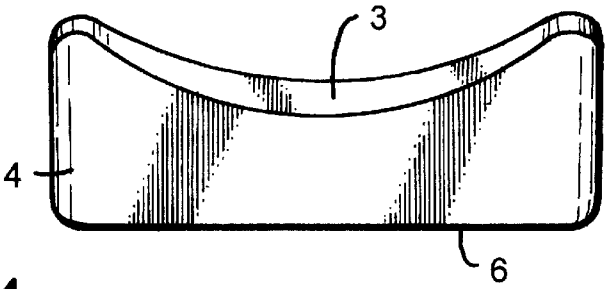
FIG. 4 is an end view taken from the end opposite the wrist end of the forearm and wrist support.

The forearm and wrist support 1 of this invention is sized to support nearly the entire forearm and cradle the underside of the wrist. So the support 1 keeps the elbow and wrist in a straight line, which may, along with other precautions and treatments, help prevent and relieve repetitive stress injuries like carpal tunnel syndrome. The inner cushion 9 is molded into a contour which comfortably and naturally holds the forearm and wrist. The gradual taper or incline of the groove 3 upward from the back or vertical end 4 to the front or wrist end 5 of the support 1, as illustrated more clearly in the end view of FIG. 4, helps make the support 1 a natural rest. The hand fits level on top of the computer mouse 7, creating a soothing working position for smooth and steady maneuvering of the mouse 7. The nylon 11 on the bottom surface 6 provides unrestricted but controllable sliding movement. The foam inner cushion 9 and POLARTEC outer shell 10 provide extreme comfort and durability.

The forearm and wrist support 1 can be used by right or left handed people. It is light weight and portable. The support 1 works with any personal computer mouse, with or without a mouse pad, and may also be used with trackballs for laptop computers. The support 1 requires no hardware installations and no software configurations.

Since minor changes and modifications varied to fit particular operating requirements and environments will be understood by those skilled in the art, the invention is not considered limited to the specific examples chosen for purposes of illustration. The invention includes all changes and modification which do not constitute a departure from the true spirit and scope of this invention as claimed in the following claims and as represented by reasonable equivalents to the claimed elements.

What is claimed is:

1. A forearm and wrist support for a computer mouse user, said support having a length sufficient to keep an elbow and wrist of said user in a straight line while maneuvering a computer mouse, said support having a width, said support being curved across said width to form a groove extending along said length of said support, said groove forming a top surface of said support, said support having a bottom surface, one end of said support having an outward incline from said bottom surface to said top surface, whereby said computer mouse may be snugly fit against said outward inclined end and easily moved with said support.

2. A forearm and wrist support as in claim 1 wherein said length of said support is approximately nine and one-half inches.

3. A forearm and wrist support as in claim 1 wherein said width of said support is wide enough to support broad forearms and wrists.

4. A forearm and wrist support as in claim 1 wherein said groove is contoured to conform to a general shape of the forearm without enfolding or gripping the forearm.

5. A forearm and wrist support as in claim 4 wherein said groove has a slight upward angle from an opposite end of said support to said outward inclined end for greater comfort.

6. A forearm and wrist support as in claim 4 wherein said support has an inner cushion.

7. A forearm and wrist support as in claim 6 wherein said inner cushion is made of a foam having a density which resists bending.

8. A forearm and wrist support as in claim 6 wherein said inner cushion is covered by a soft outer shell.

9. A forearm and wrist support as in claim 8 wherein said soft outer shell is a breathable, durable material.

10. A forearm and wrist support as in claim 9 wherein said material is a comfortable, perspiration-absorbing, washable and non-piling fabric.

11. A forearm and wrist support as in claim 8 wherein said bottom surface of said support is made of a material which allows said support to be easily moved with control across a table or desk top together with said computer mouse.

12. A forearm and wrist support as in claim 11 wherein said bottom surface material of said support is nylon.

13. A forearm and wrist support for a computer mouse user, said support comprising an inner cushion covered by an outer shell of soft material, said inner cushion being made of foam having a density which resists bending, said support having a bottom surface made of a material which allows said support to easily slide with control across a table or desk top together with a computer mouse, said support having a width and a length, said support being curved across said width to form a groove extending along said length of said support, said groove being contoured to conform to a general shape of the forearm without enfolding or gripping the forearm.

14. A forearm and wrist support as in claim 13 wherein said bottom surface material of said support is nylon.

15. A forearm and wrist support as in claim 13 wherein said soft material of said outer shell is a comfortable, breathable, durable, perspiration-absorbing, washable and non-piling fabric.

16. A forearm and wrist support as in claim 13 wherein said length of said support is sufficient to keep an elbow and wrist of said user in a straight line while maneuvering said computer mouse.

* * * * *